US009016077B2

(12) United States Patent
Cho et al.

(10) Patent No.: US 9,016,077 B2
(45) Date of Patent: Apr. 28, 2015

(54) REFRIGERATOR AND CONTROL METHOD THEREOF

(71) Applicant: Samsung Electronics Co., Ltd., Suwon-si, Gyeonggi-do (KR)

(72) Inventors: Sung Ho Cho, Gwangju (KR); Chang Hern Lee, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 391 days.

(21) Appl. No.: 13/645,605

(22) Filed: Oct. 5, 2012

(65) Prior Publication Data

US 2013/0086928 A1 Apr. 11, 2013

(30) Foreign Application Priority Data

Oct. 6, 2011 (KR) ..... 10-2011-0101715

(51) Int. Cl.

| | |
|---|---|
| ***F25D 21/06*** | (2006.01) |
| ***F25D 17/06*** | (2006.01) |
| ***F25D 29/00*** | (2006.01) |
| ***F25D 21/00*** | (2006.01) |
| *F25D 17/04* | (2006.01) |

(52) U.S. Cl.

CPC ..... *F25D 29/00* (2013.01); *F25D 21/006* (2013.01); *F25D 17/045* (2013.01); *F25B 2600/0251* (2013.01); *F25D 2600/02* (2013.01); *F25D 2700/12* (2013.01); *F25D 17/065* (2013.01); *F25D 2317/061* (2013.01)

(58) Field of Classification Search

CPC ... F25D 17/062; F25D 17/065; F25D 21/006; F25D 21/06; F25D 21/08

USPC ..... 62/151, 155, 156, 178, 179, 186, 187, 62/441

See application file for complete search history.

(56) References Cited

U.S. PATENT DOCUMENTS

| | | | | |
|---|---|---|---|---|
| 2004/0107726 | A1 | 6/2004 | Kim et al. | |
| 2008/0016889 | A1 * | 1/2008 | Jung | 62/187 |
| 2008/0314054 | A1 | 12/2008 | An et al. | |
| 2014/0208783 | A1 * | 7/2014 | Lee et al. | 62/89 |

OTHER PUBLICATIONS

Extended European Search Report dated Dec. 5, 2013 in European Patent Application No. 12186972.1 (six pages).

* cited by examiner

*Primary Examiner* — Marc Norman
(74) *Attorney, Agent, or Firm* — Staas & Halsey LLP

(57) ABSTRACT

A refrigerator includes a low-temperature storage compartment damper to control supply of cool air to a low-temperature storage compartment, a high-temperature storage compartment damper to control supply of hot air to a high-temperature storage compartment, and a controller to control the low-temperature storage compartment damper to be opened and the high-temperature storage compartment damper to be closed while controlling a compressor and blowing fan to be driven so that the temperature of the low-temperature storage compartment reaches a low set temperature, to control the driving of the compressor and blowing fan to be stopped and the low-temperature storage compartment damper to be closed when the temperature of the low-temperature storage compartment reaches the low set temperature, and to control a defrosting heater and the blowing fan to be driven and the high-temperature storage compartment damper to be opened when the supply of cool air is stopped.

18 Claims, 5 Drawing Sheets

REFRIGERATOR AND CONTROL METHOD THEREOF

CROSS-REFERENCE TO RELATED APPLICATIONS

This application claims the priority benefit of Korean Patent Application No. 10-2011-0101715, filed on Oct. 6, 2011 in the Korean Intellectual Property Office, the disclosure of which is incorporated herein by reference.

BACKGROUND

1. Field

The following description relates to a refrigerator that controls storage compartments to high temperature or low temperature, and a control method thereof.

2. Description of the Related Art

A refrigerator is an appliance that keeps food and drinks fresh for a long period of time.

The refrigerator has a plurality of storage compartments, which include a freezer compartment to store food and drinks in a frozen state, and a refrigerator compartment to store food and drinks in a refrigerated state. The refrigerator repeatedly performs a refrigeration cycle including compression, condensation, expansion, and evaporation to maintain temperatures of the freezer compartment and the refrigerator compartment at predetermined target temperatures.

The refrigerator includes a compressor, condenser, expansion valve (or capillary tube), and evaporator to perform the refrigeration cycle including compression, condensation, expansion, and evaporation.

That is, the refrigerator drives a fan provided in the freezer compartment and/or a fan provided in the refrigerator compartment, and, based on the target temperature of the freezer compartment and the target temperature of the refrigerator compartment, to blow air heat-exchanged by the evaporator to the corresponding storage(s) compartment so that the temperature of the corresponding storage compartment(s) is maintained at the target temperature(s).

For a refrigerator including a storage compartment in which an evaporator is not installed, cool air generated by an evaporator installed in another storage compartment may be introduced into the storage compartment having no evaporator to maintain the target temperature of the storage compartment having no evaporator.

SUMMARY

Therefore, the following description relates to a refrigerator having a plurality of storage compartments selectively used as a low-temperature storage compartment and a high-temperature storage compartment, and a control method thereof.

A refrigerator may include a cooling system that may include an evaporator, which may accumulate frost during a cooling cycle. To remove this accumulated frost, the cooling system may include a defrosting heater provided at the evaporator. The evaporator may be used to cool a first storage compartment, and the defrosting heater may additionally be used to warm a second storage compartment. Therefore, a single cooling system may be used to regulate the temperatures of separate storage compartments at a different temperature for each respective compartment.

To improve system efficiency, a first delay may be introduced when switching the cooling system from cooling to warming and vice versa, and a second delay may be introduced for the cooling system to reach a desired temperature before supplying heat-exchanged air to a respective storage compartment. Also, cooling the first storage compartment may be given priority over warming the second storage compartment, such that warming the second storage compartment may be interrupted by cooling the first storage compartment.

The refrigerator may include a first damper to isolate the cooling system from the first storage compartment, and a second damper to isolate the cooling system from the second storage compartment. The first and second damper may open and close independently to connect the cooling system with the respective compartment to regulate the temperature of each respective compartment.

Additional aspects of the invention will be set forth in part in the description which follows and, in part, will be obvious from the description, or may be learned by practice of the invention.

In accordance with an aspect, a refrigerator includes a plurality of storage compartments, a cool air supply device including a compressor and condenser provided at a rear lower part of a main body, and an evaporator, blowing fan, and defrosting heater installed in one of the storage compartments, a low-temperature storage compartment damper to control supply of cool air to a low-temperature storage compartment selected from the storage compartments, a high-temperature storage compartment damper to control supply of hot air to a high-temperature storage compartment selected from the storage compartments, and a controller to control the low-temperature storage compartment damper to be opened and the high-temperature storage compartment damper to be closed while controlling the compressor and blowing fan to be driven so that the temperature of the low-temperature storage compartment reaches a low set temperature, thereby supplying cool air to the low-temperature storage compartment, to control the driving of the compressor and blowing fan to be stopped and the low-temperature storage compartment damper to be closed when the temperature of the low-temperature storage compartment reaches the low set temperature, thereby stopping the supply of cool air to the low-temperature storage compartment, and to control the defrosting heater and blowing fan to be driven and the high-temperature storage compartment damper to be opened when the supply of cool air is stopped, thereby supplying hot air to the high-temperature storage compartment.

Also, the controller may control the compressor to be driven and, after a predetermined time, may control the blowing fan to be driven so that the temperature of the low-temperature storage compartment reaches the low set temperature.

Also, the controller may control the defrosting heater to be driven after a predetermined time when the supply of cool air to the low-temperature storage compartment is stopped.

Also, the controller may control the defrosting heater to be driven and, after a predetermined time, may control the blowing fan to be driven.

Also, the controller may control the driving of the defrosting heater to be stopped when the temperature of the high-temperature storage compartment reaches a high set temperature, or the temperature of the low-temperature storage compartment is equal to or greater than the low set temperature, after hot air is supplied to the high-temperature storage compartment, and may control the compressor to be driven after a predetermined time when the driving of the defrosting heater is stopped.

Also, the controller may control the driving of the blowing fan to be stopped, the high-temperature storage compartment damper to be closed, and the compressor to be driven after a predetermined time when the driving of the defrosting heater is stopped.

The high set temperature may be set so that the temperature of the high-temperature storage compartment is approximately 10° C. or higher.

In accordance with an aspect, a refrigerator includes a low-temperature compartment, a high-temperature compartment, a cool air supply device including a compressor and condenser provided at a rear lower part of a main body, and an evaporator, blowing fan, and defrosting heater installed in the low-temperature compartment, a low-temperature storage compartment damper to control supply of cool air to the low-temperature compartment, a high-temperature storage compartment damper to control supply of hot air to the high-temperature compartment, and a controller to control the low-temperature storage compartment damper to be opened and the high-temperature storage compartment damper to be closed while controlling the compressor and blowing fan to be driven so that the temperature of the low-temperature compartment reaches a low set temperature, thereby supplying cool air to the low-temperature compartment, to control the driving of the compressor and blowing fan to be stopped and the low-temperature storage compartment damper to be closed when the temperature of the low-temperature compartment reaches the low set temperature, thereby stopping the supply of cool air to the low-temperature compartment, and to control the defrosting heater and blowing fan to be driven and the high-temperature storage compartment damper to be opened when the supply of cool air is stopped, thereby supplying hot air to the high-temperature compartment.

Also, the controller may control the compressor to be driven and, after a predetermined time, may control the blowing fan to be driven so that the temperature of the low-temperature compartment reaches the low set temperature.

Also, the controller may control the defrosting heater to be driven after a predetermined time when the supply of cool air to the low-temperature compartment is stopped.

Also, the controller may control the defrosting heater to be driven and, after a predetermined time, may control the blowing fan to be driven.

Also, the controller may control the driving of the defrosting heater to be stopped when the temperature of the high-temperature compartment reaches a high set temperature, or the temperature of the low-temperature compartment is equal to or greater than the low set temperature, after hot air is supplied to the high-temperature compartment, and may control the compressor to be driven after a predetermined time when the driving of the defrosting heater is stopped.

Also, the controller may control the driving of the blowing fan to be stopped, the high-temperature storage compartment damper to be closed, and the compressor to be driven after a predetermined time when the driving of the defrosting heater is stopped.

The high set temperature may be set so that the temperature of the high-temperature compartment is approximately 10° C. or higher.

In accordance with an aspect, a control method of a refrigerator, including a low-temperature compartment, a high-temperature compartment, a cool air supply device including a compressor and condenser provided at a rear lower part of a main body, and an evaporator, blowing fan, and defrosting heater installed in the low-temperature compartment, a low-temperature storage compartment damper to control supply of cool air to the low-temperature compartment, and a high-temperature storage compartment damper to control supply of hot air to the high-temperature compartment, includes controlling the low-temperature storage compartment damper to be opened and the high-temperature storage compartment damper to be closed while controlling the compressor and blowing fan to be driven so that the temperature of the low-temperature compartment reaches a low set temperature, thereby supplying cool air to the low-temperature compartment, controlling the driving of the compressor and blowing fan to be stopped and the low-temperature storage compartment damper to be closed when the temperature of the low-temperature compartment reaches the low set temperature, thereby stopping the supply of cool air to the low-temperature compartment, and controlling the defrosting heater and blowing fan to be driven and the high-temperature storage compartment damper to be opened when the supply of cool air is stopped, thereby supplying hot air to the high-temperature compartment.

The control method may further include controlling the compressor to be driven and, after a predetermined time, controlling the blowing fan to be driven so that the temperature of the low-temperature compartment reaches the low set temperature.

The control method may further include controlling the defrosting heater to be driven after a predetermined time when the supply of cool air to the low-temperature compartment is stopped.

The control method may further include controlling the blowing fan to be driven after a predetermined time when the defrosting heater is driven.

The control method may further include controlling the driving of the defrosting heater to be stopped when the temperature of the high-temperature compartment reaches a high set temperature, or the temperature of the low-temperature compartment is equal to or greater than the low set temperature, after hot air is supplied to the high-temperature compartment, and controlling the compressor to be driven after a predetermined time when the driving of the defrosting heater is stopped.

The control method may further include controlling the driving of the blowing fan to be stopped, the high-temperature storage compartment damper to be closed, and the compressor to be driven after a predetermined time when the driving of the defrosting heater is stopped.

In accordance with an aspect, a method of regulating a first temperature of a first storage compartment and a second temperature of a second storage compartment includes generating cold air with a compressor, condenser, and evaporator; supplying the generated cold air, with a blowing fan, to the first storage compartment to regulate the temperature of the first storage compartment below a predetermined first temperature; generating hot air with a defrosting heater; supplying the generated hot air, with the blowing fan, to the second storage compartment to regulate the temperature of the second storage compartment above a predetermined second temperature; isolating the first storage compartment from the hot air supply with a first damper; and isolating the second storage compartment from the cold air supply with a second damper.

The method of regulating the temperatures may further include giving priority to regulating the temperature of the first storage compartment over regulating the temperature of the second storage compartment.

The method of regulating the temperatures may further include delaying the supplying of the generated hot air for a predetermined time after generating hot air.

The method of regulating the temperatures may further include delaying the supplying of the generated cold air for a predetermined time after generating cold air.

The method of regulating the temperatures may further include defrosting the evaporator with the defrosting heater.

In accordance with an aspect, a non-transitory computer readable recording medium may store a program to implement the method of regulating the temperatures.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
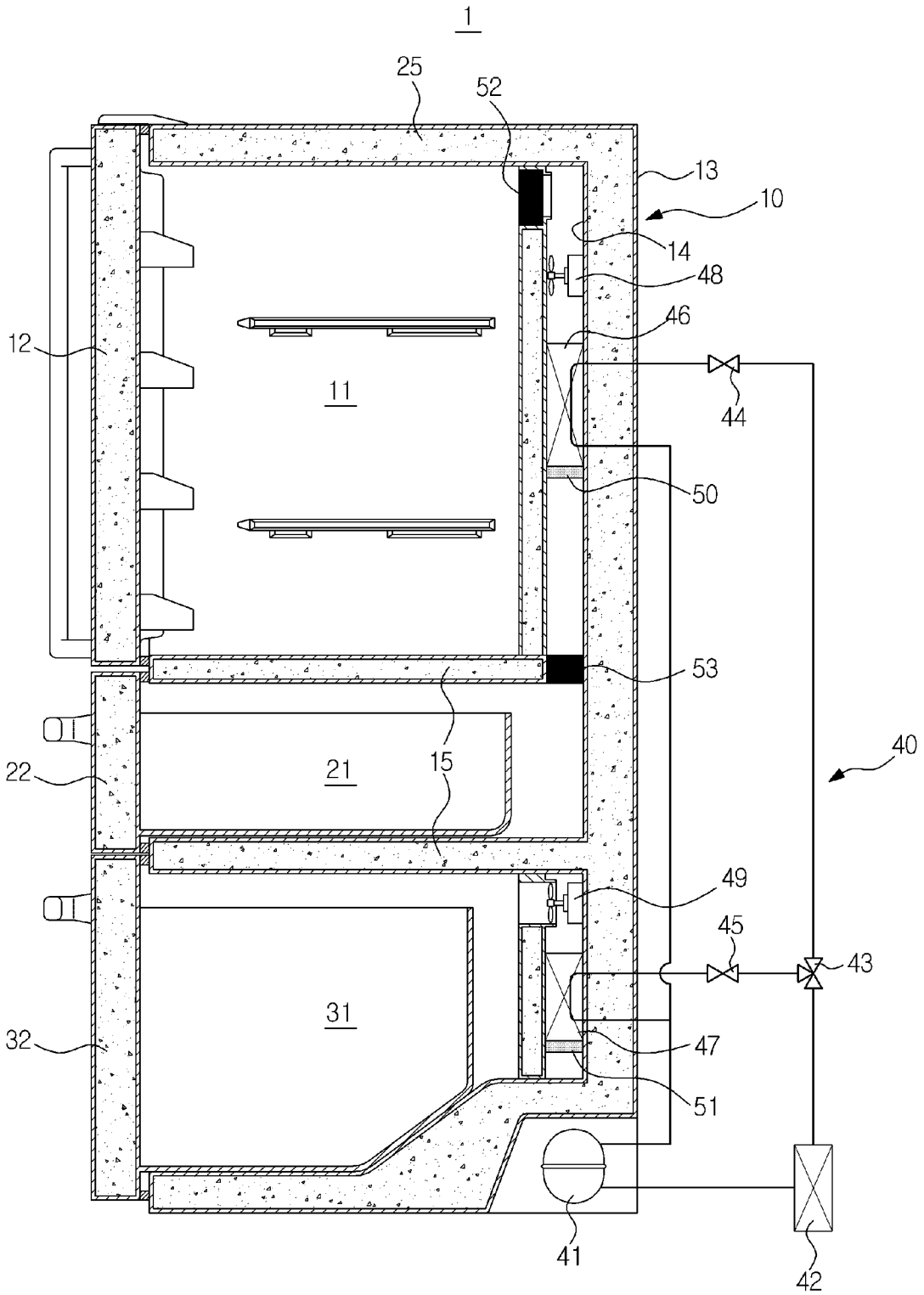
FIG. 1 is a schematic side sectional view of a refrigerator according to an embodiment.

Reference will now be made in detail to the embodiments, examples of which are illustrated in the accompanying drawings, wherein like reference numerals refer to like elements throughout.

FIG. 1 is a schematic side sectional view of a refrigerator 1 according to an embodiment.

Referring to FIG. 1, the refrigerator 1 includes a main body 10 having a plurality of storage compartments, such as three storage compartments 11, 21, and 31, for example. The storage compartments 11, 21, and 31 include two upper and middle storage compartments 11 and 21 that may be used as low-temperature storage compartments or high-temperature storage compartments and a lower storage compartment 31, which is a freezer compartment. The storage compartments 11 and 21 may be used as low-temperature storage compartments, such as refrigerator compartments, for example, or as high-temperature storage compartments, such as ripening compartments, for example. That is, the storage compartment 11 may be used as a low-temperature storage compartment, and the storage compartment 21 may be used as a high-temperature storage compartment. Alternatively, the storage compartment 11 may be used as a high-temperature storage compartment, and the storage compartment 21 may be used as a low-temperature storage compartment. In the following description, the storage compartment 11 is used as a low-temperature storage compartment, and the storage compartment 21 is used as a high-temperature storage compartment.

Each of the storage compartments is open at the front thereof. Doors 12, 22, and 32 are installed at the open fronts of the storage compartments 11, 21, and 31, respectively, so that the doors 12, 22, and 32 are opened and closed.

The storage compartments are partitioned by intermediate walls 15. The intermediate walls 15 are filled with insulation foam to prevent heat exchange between the respective storage compartments.

In each of the storage compartments, a temperature sensor (not shown) is provided to measure the interior temperature thereof.

The main body 10 includes an inner liner 14 defining the respective storage compartments, an outer liner 13 coupled to the outside of the inner liner 14 to form the external appearance of the refrigerator 1, and an insulation wall 25 formed by filling a space between the inner liner 14 and the outer liner 13 with insulation foam.

A cool air supply system 40, including a compressor 41, a condenser 42, evaporators 46 and 47, expansion valves 44 and 45, blowing fans 48 and 49, and defrosting heaters 50 and 51, is provided to supply cool air to the storage compartments.

The compressor 41 is installed in a machinery compartment provided at the lower part of the main body 10. When external electric energy is supplied to the compressor 41, the compressor 41 compresses a refrigerant into a high-temperature, high-pressure refrigerant using rotational force generated by an electric motor. The high-temperature, high-pressure refrigerant is condensed while passing through the condenser 42 provided at the rear of the main body 10.

The condensed refrigerant flows to the evaporators 46 and 47 disposed at different storage compartments according to selective switching of a flow channel by a switching value 43. The condensed refrigerant is changed into a low-temperature, low-pressure liquid refrigerant while passing through the expansion valves 44 and 45 and then flows to the evaporators 46 and 47.

The evaporators 46 and 47 evaporate the low-temperature, low-pressure liquid refrigerant, having passed through the expansion valves 44 and 45, to cool ambient air. As a result, cool air is generated.

The completely evaporated refrigerant is resupplied to the compressor 41 so that the refrigeration cycle is repeated. Also, the defrosting heaters 50 and 51 to remove frost formed on the evaporators 46 and 47 during generation of cool air using heat are provided at the evaporators 46 and 47. Defrosting heater temperature sensors (not shown) to sense temperatures of the defrosting heaters 50 and 51 may be provided at the defrosting heaters 50 and 51.

In the low-temperature storage compartment 11, a damper 52 is installed to introduce the cool air generated by the evaporator 46 into the low-temperature storage compartment 11. The low-temperature storage compartment damper 52 is opened and closed to control the introduction of the cool air generated by the evaporator 46 into the low-temperature storage compartment 11. In a case in which the storage compartment 11 is used as a high-temperature storage compartment, the introduction of hot air generated by the driving of the defrosting heater 50 into the storage compartment 11 is controlled by the damper 52.

In the high-temperature storage compartment 21, a damper 53 is installed to introduce hot air generated by the driving of the defrosting heater 50 of the low-temperature storage compartment 11 into the high-temperature storage compartment 21. The high-temperature storage compartment damper 53 is opened and closed to control the introduction of hot air generated by the driving of the defrosting heater 50 into the high-temperature storage compartment 21. In a case in which the storage compartment 21 is used as a low-temperature storage compartment, the introduction of the cool air generated by the evaporator 46 into the storage compartment 21 is controlled by the damper 53.

That is, a damper is installed in the high-temperature storage compartment 21 to introduce cool air or hot air generated by the evaporator 46 or the defrosting heater 50 installed in the low-temperature storage compartment 11 into the high-temperature storage compartment 21. The cool air or hot air is selected depending upon whether the storage compartment 21 is used as a low-temperature storage compartment or a high-temperature storage compartment.

Meanwhile, the compressor 41 compresses and supplies a refrigerant to the condenser 42 to perform the refrigeration cycle including compression, condensation, expansion, and evaporation. When the compressor 41 is driven, therefore, cool air generated by the evaporator 46 is supplied to the storage compartments. At this time, the low-temperature storage compartment damper 52 is opened, and the high-temperature storage compartment damper 53 is closed. As a result, the cool air is introduced into only the low-temperature storage compartment 11.

The driving time of the compressor 41 is determined based on the temperature of the low-temperature storage compartment 11. Specifically, the compressor 41 is driven until the temperature of the low-temperature storage compartment 11 reaches a low set temperature. The low set temperature indicates a temperature at which the low-temperature storage compartment 11 performs a refrigeration function or a freezing function.

The defrosting heater 50 generates heat to remove frost formed on the evaporator 46. Air is heated by heat generated at this time into hot air. The hot air is introduced into the high-temperature storage compartment 21. At this time, the low-temperature storage compartment damper 52 is closed, and the high-temperature storage compartment damper 53 is opened. As a result, the hot air is introduced into only the high-temperature storage compartment 21.

The driving time of the defrosting heater 50 is determined based on the temperature of the high-temperature storage compartment 21. The defrosting heater 50 is driven when the driving of the compressor 41 is stopped. To efficiently generate hot air, however, the defrosting heater 50 is not driven immediately after the driving of the compressor 41 is stopped but is driven after a predetermined time has elapsed. For example, the defrosting heater is driven approximately 1 minute after the driving of the compressor 41 is stopped. The defrosting heater is continuously driven until the temperature of the high-temperature storage compartment 21 reaches a high set temperature. The high set temperature is set so that the temperature of the high-temperature storage compartment 21 is approximately 10° C. or higher, for example.

An algorithm to use the storage compartments in various ways through the operation of the cool air supply device, including the compressor 41 and the defrosting heater 50, and the dampers installed in the low-temperature storage compartment 11 and the high-temperature storage compartment 21 will be described in detail below.

Figure 2:
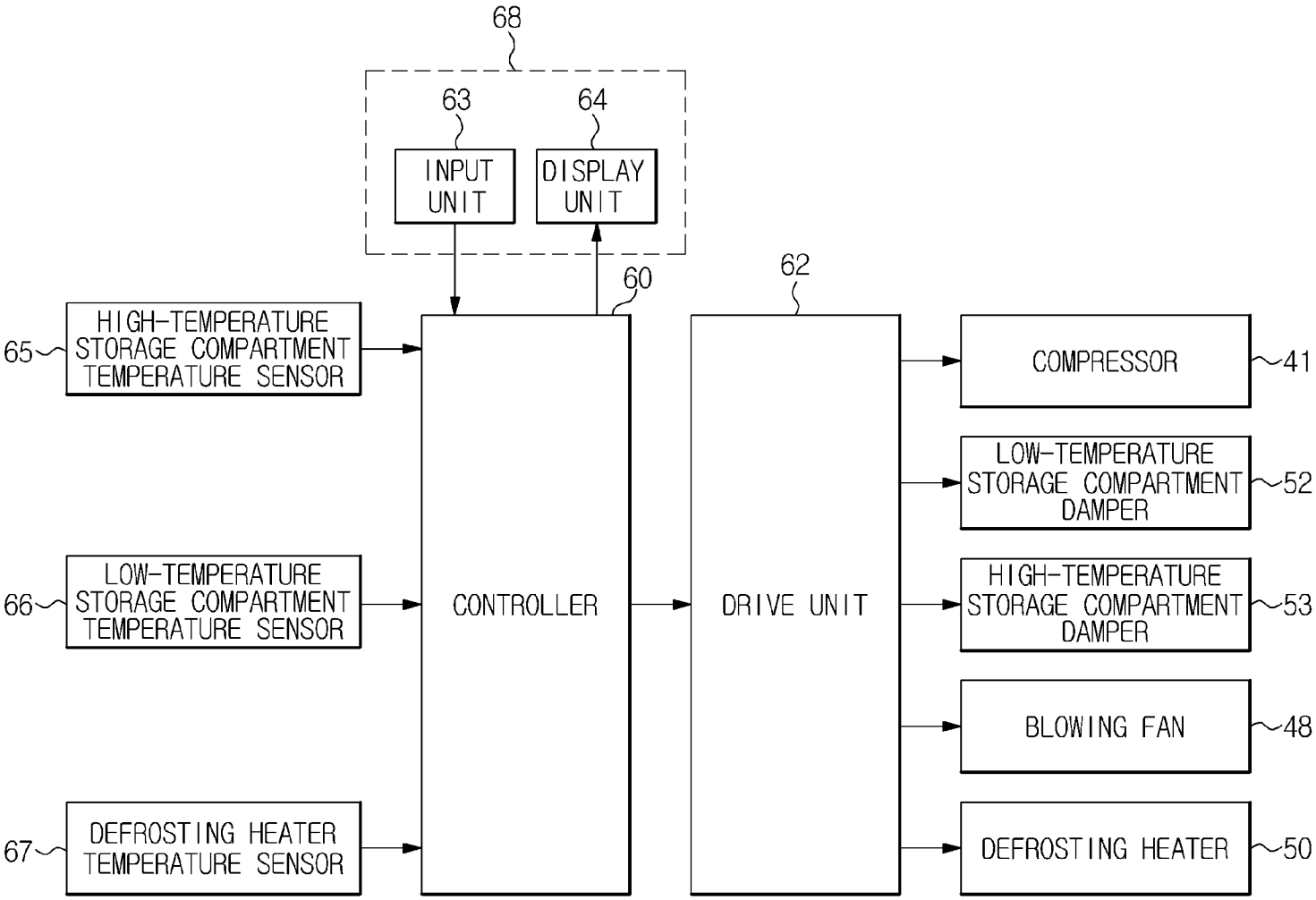
FIG. 2 is a block diagram showing the construction of the refrigerator according to the embodiment.
Figure 3:
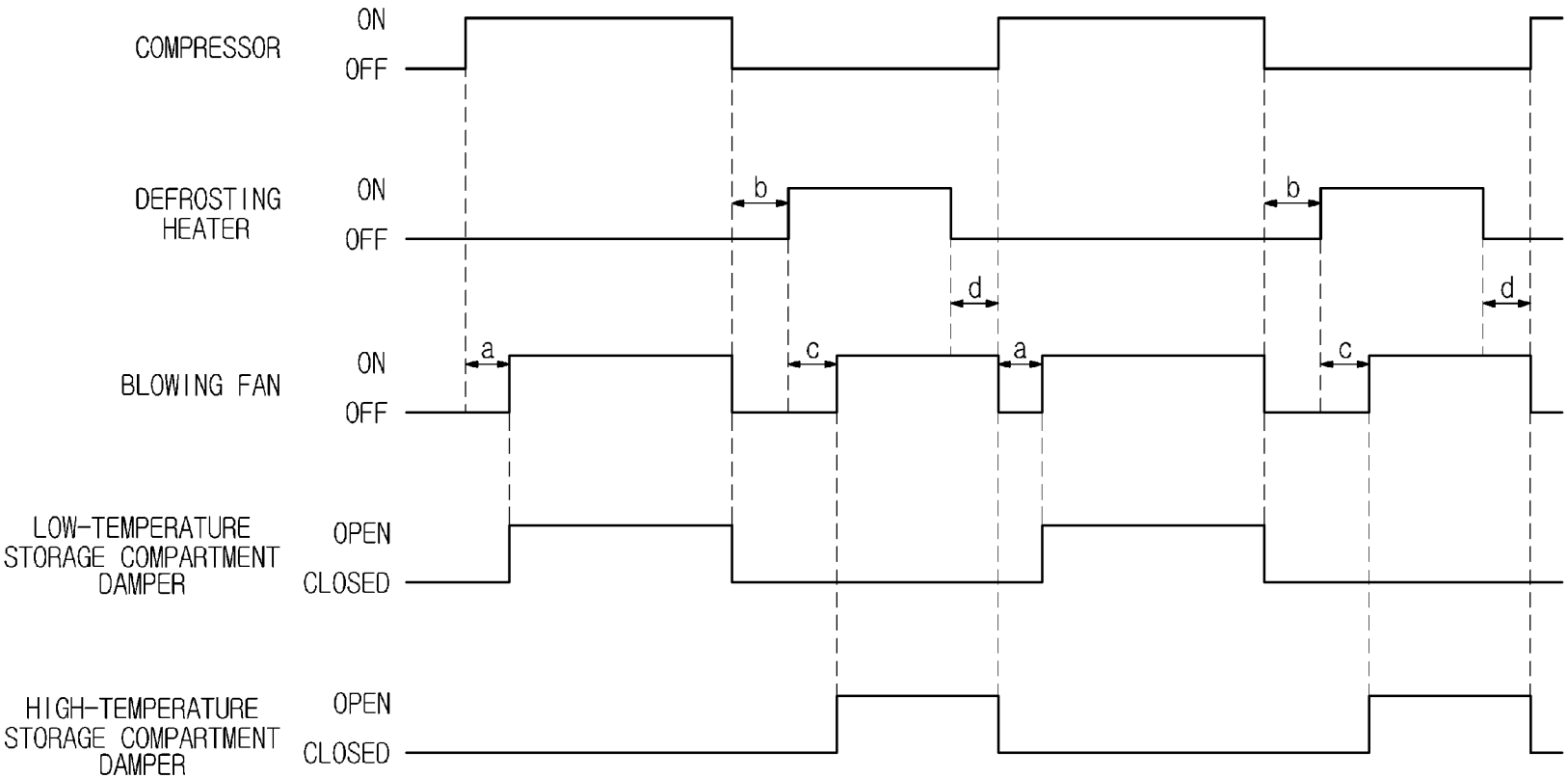
FIG. 3 is a graph showing the operation of the refrigerator according to the embodiment.

FIG. 2 is a block diagram showing the construction of the refrigerator according to the embodiment, and FIG. 3 is a graph showing the operation of the refrigerator according to the embodiment.

As shown in FIG. 2, the refrigerator 1 includes a user interface 68 including an input unit 63 to manipulate a function of the refrigerator 1 and a display unit 64 to display a state or operation information of the refrigerator 1, a high-temperature storage compartment temperature sensor 65 to sense temperature of the high-temperature storage compartment 21, a low-temperature storage compartment temperature sensor 66 to sense temperature of the low-temperature storage compartment 11, a defrosting heater temperature sensor 67 to sense temperature of the defrosting heater 50, a drive unit 62 to drive the compressor 41, the low-temperature storage compartment damper 52, the high-temperature storage compartment damper 53, the blowing fan 48, and the defrosting heater 50 according to a command from the controller 60, and a controller 60 to output a control signal to control the driving of the compressor 41, the low-temperature storage compartment damper 52, the high-temperature storage compartment damper 53, the blowing fan 48, and the defrosting heater 50 according to user input through the input unit 63 or temperatures sensed by the respective temperature sensors to the drive unit 62.

Upon receiving a command indicating that the upper storage compartment is used as a low-temperature storage compartment, e.g. a refrigerator compartment, and the middle storage compartment is used as a high-temperature storage compartment, e.g. a ripening compartment, from the input unit 63, the controller 60 determines whether the temperature of the low-temperature storage compartment 11 sensed by the low-temperature storage compartment temperature sensor 66 is higher than the low set temperature.

Upon determining that the temperature of the low-temperature storage compartment 11 is higher than the low set temperature, i.e. the temperature of the low-temperature storage compartment 11 exceeds the upper limit of the low set temperature range, the controller 60 outputs a command to drive the compressor 41 to the drive unit 62 so that the compressor 41 is driven.

When the compressor 41 is driven and then a first set time "a" (see FIG. 3) elapses, the controller 60 outputs a command to drive the blowing fan 48 to the drive unit 62 so that the blowing fan 48 is driven. The blowing fan 48 is not driven immediately after the compressor 41 is driven. That is, the compressor is given time to generate cool air, and then the blowing fan 48 is driven to improve cooling efficiency. The first set time "a" will be described below.

Also, the controller 60 outputs a command to open the low-temperature storage compartment damper 52 to the drive unit 62 so that the low-temperature storage compartment damper 52 is opened. At this time, the high-temperature storage compartment damper 53 is in a closed state (see FIG. 3). As a result, cool air generated by the evaporator 46 is introduced only into the low-temperature storage compartment 11.

When the temperature of the low-temperature storage compartment 11 sensed by the low-temperature storage compartment temperature sensor 66 reaches the low set temperature, the controller 60 stops the driving of the compressor 41 and the blowing fan 48, and outputs a command to close the low-temperature storage compartment damper 52 to the drive unit 62.

When the driving of the compressor 41 and the blowing fan 48 is stopped, and the low-temperature storage compartment damper 52 is closed, the controller 60 outputs a command to drive the defrosting heater 50 to the drive unit 62 after a second set time "b". That is, the defrosting heater 50 is not immediately driven but is driven after a second set time "b". As a result, the amount of power consumed to drive the defrosting heater 50 may be reduced, thereby improving defrosting efficiency and hot air generation efficiency. This is because cool air still remains immediately after the driving of the compressor 41 is stopped, and the temperature of frost formed thereon is lower than the cool air, with the result that a larger amount of power may be consumed to perform defrosting and generate hot air.

When the defrosting heater 50 is driven, the controller 60 outputs a command to drive the blowing fan 48 to the drive unit 62 after a third set time "c". The blowing fan 48 is not driven immediately after the defrosting heater 50 is driven. That is, the defrosting heater is given time to generate hot air, and then the blowing fan 48 is driven to improve supply efficiency of hot air to the high-temperature storage compartment 21. The third set time "c" may be set to a time taken until the temperature of the defrosting heater 50 sensed by the defrosting heater temperature sensor 67 is equal to or greater than a predetermined temperature of the high-temperature storage compartment 21. The predetermined temperature of the high-temperature storage compartment 21 may be set to, for example, a temperature obtained by subtracting approximately 3° C. from the temperature of the high-temperature storage compartment 21 sensed by the high-temperature storage compartment temperature sensor 65 immediately after the defrosting heater 50 is driven. As the predetermined temperature of the high-temperature storage compartment 21 is set to a temperature slightly lower than the temperature sensed by the high-temperature storage compartment temperature sensor 65, hot air is more rapidly supplied to the high-temperature storage compartment 21, thereby further improving hot air supply efficiency. Also, the controller 60 outputs a command to open the high-temperature storage compartment damper 53 to the drive unit 62.

When the temperature of the high-temperature storage compartment 21 sensed by the high-temperature storage compartment temperature sensor 65 reaches the high set temperature or when the temperature of the low-temperature storage compartment 11 sensed by the low-temperature storage compartment temperature sensor 66 is equal to or greater than the low set temperature, the controller 60 outputs a command to stop the driving of the defrosting heater 50 to the drive unit 62. The high set temperature is set so that the temperature of the high-temperature storage compartment 21 is approximately 10° C. or higher, for example. Generally, the high set temperature is set to a temperature appropriate to perform a high-temperature function, such as a Kimchi fermentation function, for example. When the temperature of the low-temperature storage compartment 11 is equal to or greater than the low set temperature although the temperature of the high-temperature storage compartment 21 has not reached the high set temperature, the controller 60 outputs a command to stop the driving of the defrosting heater 50 to the drive unit 62. That is, the controller 60 controls the respective components to achieve the supply of cool air to the low-temperature storage compartment 11 so that the low-temperature storage compartment 11 performs a low-temperature function to be carried out prior to the supply of hot air to the high-temperature storage compartment 21 so that the high-temperature storage compartment 21 performs a high-temperature function.

When the driving of the defrosting heater 50 is stopped, the controller 60 does not immediately drive the compressor 41 but drives the compressor 41 after a fourth set time "d". That is, when the driving of the defrosting heater 50 is stopped, the controller 60 does not immediately stop the blowing fan 48 but further drives the blowing fan 48 for the fourth set time "d". While the blowing fan 48 is further driven, the controller 60 keeps the high-temperature storage compartment damper 53 open. As a result, the high-temperature storage compartment 21 may be more stable in a state in which the temperature of the high-temperature storage compartment 21 reaches the high set temperature. The fourth set time "d", for which the blowing fan 48 is further driven and the driving of the compressor 41 is delayed, may be set to approximately 10 minutes, for example.

When the temperature of the low-temperature storage compartment 11 is equal to or greater than the low set temperature, although the temperature of the high-temperature storage compartment 21 has not reached the high set temperature, and therefore, it is necessary to stop the driving of the defrosting heater 50 and to drive the compressor 41, the driving of the blowing fan 48 is stopped and, at the same time, the compressor 41 is driven after the fourth set time "d" as shown in FIG. 3. As previously described, the controller 60 controls the low-temperature storage compartment 11 to be cooled according to priority. In this case, therefore, the driving of the blowing fan 48 is stopped and, at the same time, the compressor 41 is driven. However, when the temperature of the high-temperature storage compartment 21 reaches the high set temperature, and therefore, the driving of the defrosting heater 50 is stopped, the stoppage of the blowing fan 48 and the driving of the compressor 41 are not simultaneously performed but the compressor 41 is driven when the temperature of the low-temperature storage compartment 11 is equal to or greater than the low set temperature after the driving of the blowing fan 48 is stopped.

After the fourth set time "d", the controller 60 outputs a command to stop the driving of the blowing fan 48, to close the high-temperature storage compartment damper 53, and to drive the compressor 41 to the drive unit 62.

When the compressor 41 is driven and then the first set time "a" elapses as previously described, the controller 60 outputs a command to drive the blowing fan 48 to the drive unit 62 so that the blowing fan 48 is driven. The first set time "a" may be set to a time taken until the temperature of the defrosting heater 50 sensed by the defrosting heater temperature sensor 67 is equal to or less than a predetermined temperature of the low-temperature storage compartment 11. The predetermined temperature of the low-temperature storage compartment 11 may be set to, for example, a temperature obtained by adding approximately 2° C. to the temperature of the low-temperature storage compartment 11 sensed by the low-temperature storage compartment temperature sensor 66 immediately after the compressor 41 is driven. As the predetermined temperature of the low-temperature storage compartment 11 is set to a temperature slightly higher than the temperature sensed by the low-temperature storage compartment temperature sensor 66, cool air is more rapidly supplied to the low-temperature storage compartment 11, thereby further improving cool air supply efficiency.

The supply of cool air to the low-temperature storage compartment 11 and the supply of hot air to the high-temperature storage compartment 21 are repeated so that the low-temperature storage compartment 11 and the high-temperature storage compartment 21 perform a low-temperature function and a high-temperature function, respectively, using the evaporator 46 and the defrosting heater 50.

Figure 4A:
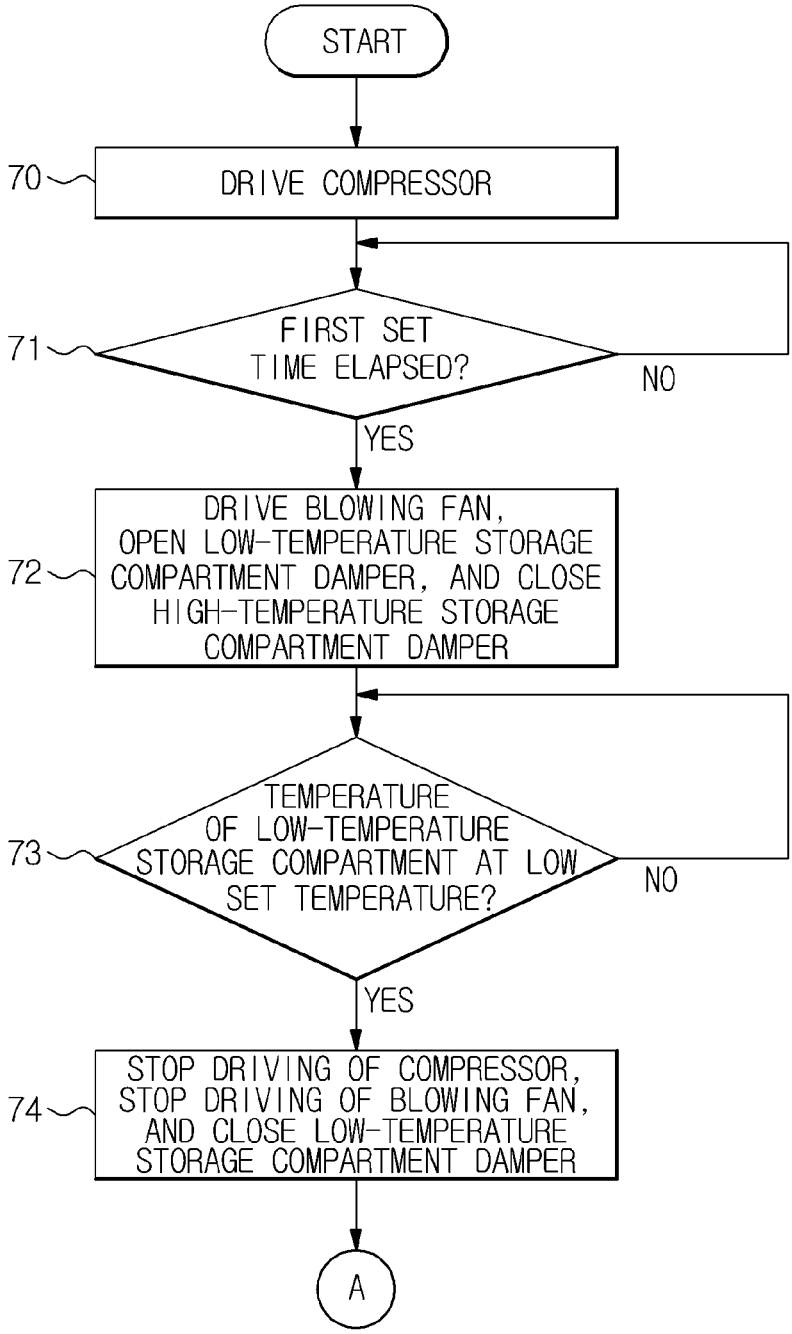
FIGS. 4A and 4B are flowcharts showing a control method of a refrigerator according to an embodiment.
Figure 4B:
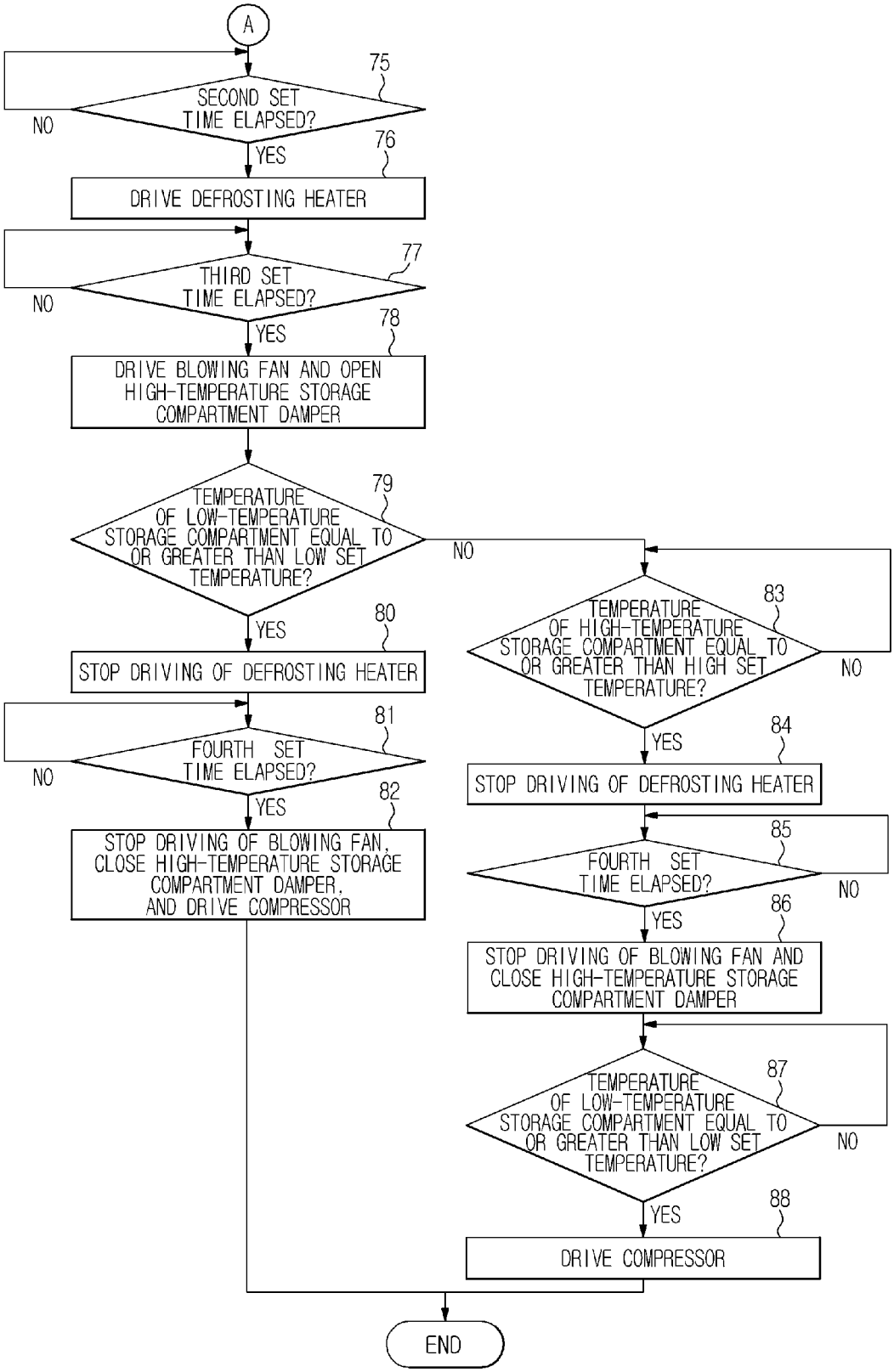

FIGS. 4A and 4B are flowcharts showing a control method of a refrigerator according to an embodiment.

Referring to FIG. 4A, the controller 60 controls the compressor 41 to be driven (70).

Upon receiving a command indicating that the upper storage compartment is used as a low-temperature storage compartment, e.g. a refrigerator compartment, and the middle storage compartment is used as a high-temperature storage compartment, e.g. a ripening compartment, from the input unit 63, the controller 60 determines whether the temperature of the low-temperature storage compartment 11 sensed by the low-temperature storage compartment temperature sensor 66 is higher than the low set temperature. Upon determining that the temperature of the low-temperature storage compartment 11 is higher than the low set temperature, i.e. the temperature of the low-temperature storage compartment 11 exceeds the upper limit of the low set temperature range, the controller 60 controls the compressor 41 to be driven.

When the compressor 41 is driven, the controller 60 determines whether a first set time "a" has elapsed after the compressor 41 is driven (71). The first set time "a" may be set to a time taken until the temperature of the defrosting heater 50 sensed by the defrosting heater temperature sensor 67 is equal to or less than a predetermined temperature of the low-temperature storage compartment 11. The predetermined temperature of the low-temperature storage compartment 11 may be set to, for example, a temperature obtained by adding approximately 2° C. to the temperature of the low-temperature storage compartment 11 sensed by the low-temperature storage compartment temperature sensor 66 immediately after the compressor 41 is driven. As the predetermined temperature of the low-temperature storage compartment 11 is set to a temperature slightly higher than the temperature sensed by the low-temperature storage compartment temperature sensor 66, cool air is more rapidly supplied to the low-temperature storage compartment 11, thereby further improving cool air supply efficiency.

After the first set time "a", the controller 60 controls the blowing fan 48 to be driven, the low-temperature storage compartment damper 52 to be opened, and the high-temperature storage compartment damper 53 to be closed (72). As a result, cool air generated by the evaporator 46 is introduced only into the low-temperature storage compartment 11. The blowing fan 48 is not driven immediately after the compressor 41 is driven. That is, the compressor is given time to generate cool air, and then the blowing fan 48 is driven to improve cooling efficiency.

The controller 60 determines whether the temperature of the low-temperature storage compartment 11 has reached a low set temperature (73). Upon determining that the temperature of the low-temperature storage compartment 11 has reached the low set temperature, the controller 60 controls the driving of the blowing fan 48 to be stopped and the low-temperature storage compartment damper 52 to be closed (74).

When the driving of the compressor 41 and the blowing fane 48 is stopped, and the low-temperature storage compartment damper 52 is closed, the controller 60 determines whether a second set time "b" has elapsed (75). Upon determining that the second set time "b" has elapsed, the controller 60 controls the defrosting heater 50 to be driven (76). Cool air remains immediately after the driving of the compressor 41 is stopped, and the temperature of frost formed thereon is lower than the cool air with the result that a larger amount of power may be consumed to perform defrosting and generate hot air. For this reason, the defrosting heater 50 is not immediately driven, but is driven after the second set time "b". As a result, the amount of power consumed to drive the defrosting heater 50 may be reduced, thereby improving defrosting efficiency and hot air generation efficiency.

When the defrosting heater 50 is driven, the controller 60 determines whether a third set time "c" has elapsed (77). Upon determining that the third set time "c" has elapsed, the controller 60 controls the blowing fan 48 to be driven and the high-temperature storage compartment damper 53 to be opened (78). The blowing fan 48 is not driven immediately after the defrosting heater 50 is driven. That is, the defrosting heater is given time to generate hot air, and then the blowing fan 48 is driven to improve supply efficiency of hot air to the high-temperature storage compartment 21. The third set time "c" may be set to a time taken until the temperature of the defrosting heater 50 sensed by the defrosting heater temperature sensor 67 is equal to or greater than a predetermined temperature of the high-temperature storage compartment 21. The predetermined temperature of the high-temperature storage compartment 21 may be set to, for example, a temperature obtained by subtracting approximately 3° C. from the temperature of the high-temperature storage compartment 21 sensed by the high-temperature storage compartment temperature sensor 65 immediately after the defrosting heater 50 is driven. As the predetermined temperature of the high-temperature storage compartment 21 is set to a temperature slightly lower than the temperature sensed by the high-temperature storage compartment temperature sensor 65, hot air is more rapidly supplied to the high-temperature storage compartment 21, thereby further improving hot air supply efficiency.

When the blowing fan 48 is driven, and the high-temperature storage compartment damper 53 is opened, the controller 60 determines whether the low-temperature storage compartment 11 is equal to or greater than the low set temperature (79). Upon determining that the low-temperature storage compartment 11 is equal to or greater than the low set temperature, the controller 60 controls the driving of the defrosting heater 50 to be stopped (80). When the driving of the defrosting heater 50 is stopped, the controller 60 determines whether a fourth set time "d" has elapsed (81). Upon determining that the fourth set time "d" has elapsed, the controller 60 controls the driving of the blowing fan 48 to be stopped, the high-temperature storage compartment damper 53 to be closed, and the compressor 41 to be driven (82).

When the driving of the defrosting heater 50 is stopped, the controller 60 does not immediately stop the blowing fan 48 but further drives the blowing fan 48 for the fourth set time "d". While the blowing fan 48 is further driven, the controller 60 keeps the high-temperature storage compartment damper 53 open. As a result, the high-temperature storage compartment 21 may be more stable in a state in which the temperature of the high-temperature storage compartment 21 reaches a high set temperature. The fourth set time "d", for which the blowing fan 48 is further driven and the driving of the compressor 41 is delayed, may be set to approximately 10 minutes, for example. In a case in which the low-temperature storage compartment 11 is equal to or greater than the low set temperature as described above, rapid supply of cool air to the low-temperature storage compartment 11 is required. For this reason, the compressor 41 is driven immediately after the driving of the blowing fan 48 is stopped.

When the low-temperature storage compartment 11 does not exceed the low set temperature, the controller 60 determines whether the temperature of the high-temperature storage compartment 21 has reached a high set temperature (83). Upon determining that the temperature of the high-temperature storage compartment 21 has reached the high set temperature, the controller 60 controls the driving of the defrosting heater 50 to be stopped (84). The high set temperature is set so that the temperature of the high-temperature storage compartment 21 is approximately 10° C. or higher. Generally, the high set temperature is set to a temperature proper to perform a high-temperature function, such as a Kimchi fermentation function, for example. When the driving of the defrosting heater 50 is stopped, the controller 60 determines whether the fourth set time "d" has elapsed (85). Upon determining that the fourth set time "d" has elapsed, the controller 60 controls the driving of the blowing fan 48 to be stopped and the high-temperature storage compartment damper 53 to be closed (86). When the driving of the blowing fan 48 is stopped, and the high-temperature storage compartment damper 53 is closed, the controller 60 determines whether the low-temperature storage compartment 11 is equal to or greater than the low set temperature (87). Upon determining that the low-temperature storage compartment 11 is equal to or greater than the low set temperature, the controller 60 controls the compressor 41 to be driven (88). In a case in which the low-temperature storage compartment 11 is less than the low set temperature, rapid supply of cool air to the low-temperature storage compartment 11 is not required. Consequently, the compressor 41 is not driven simultaneously when the blowing fan 48 is driven as in Operation 82. When the driving of the blowing fan 48 is stopped, and the high-temperature storage compartment damper 53 is closed, the controller 60 determines whether the low-temperature storage compartment 11 is equal to or greater than the low set temperature. Upon determining that the low-temperature storage compartment 11 is equal to or greater than the low set temperature, the controller 60 controls the compressor 41 to be driven.

When the low-temperature storage compartment 11 is equal to or greater than the low set temperature as previously described, the controller 60 controls the driving of the defrosting heater 50 to be stopped without determination as to whether the temperature of the high-temperature storage compartment 21 has reached the high set temperature. That is, when the temperature of the low-temperature storage compartment 11 is equal to or greater than the low set temperature although the temperature of the high-temperature storage compartment 21 has not reached the high set temperature, the controller 60 controls the driving of the defrosting heater 50 to be stopped. In this way, the controller 60 controls the respective components to achieve the supply of cool air to the low-temperature storage compartment 11 so that the low-temperature storage compartment 11 performs a low-temperature function to be carried out prior to the supply of hot air to the high-temperature storage compartment 21 so that the high-temperature storage compartment 21 performs a high-temperature function.

When the compressor 41 is driven (82 and 83), the procedure from Operation 70 is repeated.

The supply of cool air to the low-temperature storage compartment 11 and the supply of hot air to the high-temperature storage compartment 21 are repeated so that the low-temperature storage compartment 11 and the high-temperature storage compartment 21 perform a low-temperature function and a high-temperature function, respectively, using the evaporator 46 and the defrosting heater 50.

As is apparent from the above description, according to an aspect, a plurality of storage compartments may be selectively used as a low-temperature storage compartment and a high-temperature storage compartment using an evaporator and defrosting heater.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a plurality of storage compartments;

a cool air supply device comprising a compressor and condenser provided at a rear lower part of a main body and an evaporator, blowing fan, and defrosting heater installed in one of the storage compartments;

a low-temperature storage compartment damper to control supply of cool air to a low-temperature storage compartment selected from the storage compartments;

a high-temperature storage compartment damper to control supply of hot air to a high-temperature storage compartment selected from the storage compartments; and a controller to control the low-temperature storage compartment damper to be opened and the high-temperature storage compartment damper to be closed while controlling the compressor and blowing fan to be driven so that the temperature of the low-temperature storage compartment reaches a low set temperature, thereby supplying cool air to the low-temperature storage compartment, to control the driving of the compressor and blowing fan to be stopped and the low-temperature storage compartment damper to be closed when the temperature of the low-temperature storage compartment reaches the low set temperature, thereby stopping the supply of cool air to the low-temperature storage compartment, and to control the defrosting heater and blowing fan to be driven and the high-temperature storage compartment damper to be opened when the supply of cool air is stopped, thereby supplying hot air to the high-temperature storage compartment.

2. The refrigerator according to claim 1, wherein the controller controls the compressor to be driven and, after a predetermined time, controls the blowing fan to be driven so that the temperature of the low-temperature storage compartment reaches the low set temperature.

3. The refrigerator according to claim 1, wherein the controller controls the defrosting heater to be driven after a predetermined time when the supply of cool air to the low-temperature storage compartment is stopped.

4. The refrigerator according to claim 1, wherein the controller controls the defrosting heater to be driven and, after a predetermined time, controls the blowing fan to be driven.

5. The refrigerator according to claim 1, wherein the controller controls the driving of the defrosting heater to be stopped when temperature of the high-temperature storage compartment reaches a high set temperature, or the temperature of the low-temperature storage compartment is equal to or greater than the low set temperature, after hot air is supplied to the high-temperature storage compartment, and controls the compressor to be driven after a predetermined time when the driving of the defrosting heater is stopped.

6. The refrigerator according to claim 5, wherein the controller controls the driving of the blowing fan to be stopped, the high-temperature storage compartment damper to be closed, and the compressor to be driven after a predetermined time when the driving of the defrosting heater is stopped.

7. The refrigerator according to claim 5, wherein the high set temperature is set so that the temperature of the high-temperature storage compartment is 10° C. or higher.

8. A refrigerator comprising:

a first storage compartment;

a second storage compartment having higher temperature than the first storage compartment;

a cool air supply device comprising a compressor and condenser provided at a rear lower part of a main body and an evaporator, blowing fan, and defrosting heater installed in the first storage compartment;

a low-temperature storage compartment damper to control supply of cool air to the first storage compartment;

a high-temperature storage compartment damper to control supply of hot air to the second storage compartment; and a controller to control the low-temperature storage compartment damper to be opened and the high-temperature storage compartment damper to be closed while controlling the compressor and blowing fan to be driven so that the temperature of the first storage compartment reaches a low set temperature, thereby supplying cool air to the first storage compartment, to control the driving of the compressor and blowing fan to be stopped and the low-temperature storage compartment damper to be closed when the temperature of the first storage compartment reaches the low set temperature, thereby stopping the supply of cool air to the first storage compartment, and to control the defrosting heater and blowing fan to be driven and the high-temperature storage compartment damper to be opened when the supply of cool air is stopped, thereby supplying hot air to the second storage compartment.

9. The refrigerator according to claim 8, wherein the controller controls the compressor to be driven and, after a predetermined time, controls the blowing fan to be driven so that the temperature of the first storage compartment reaches the low set temperature.

10. The refrigerator according to claim 8, wherein the controller controls the defrosting heater to be driven after a predetermined time when the supply of cool air to the first storage compartment is stopped.

11. The refrigerator according to claim 8, wherein the controller controls the defrosting heater to be driven and, after a predetermined time, controls the blowing fan to be driven.

12. The refrigerator according to claim 8, wherein the controller controls the driving of the defrosting heater to be stopped when temperature of the second storage compartment reaches a high set temperature, or the temperature of the first storage compartment is equal to or greater than the low set temperature, after hot air is supplied to the second storage compartment, and controls the compressor to be driven after a predetermined time when the driving of the defrosting heater is stopped.

13. The refrigerator according to claim 12, wherein the controller controls the driving of the blowing fan to be stopped, the high-temperature storage compartment damper to be closed, and the compressor to be driven after a predetermined time when the driving of the defrosting heater is stopped.

14. The refrigerator according to claim 12, wherein the high set temperature is set so that the temperature of the second storage compartment is 10° C. or higher.

15. A control method of a refrigerator comprising: a first storage compartment; a second storage compartment having higher temperature than the first storage compartment; a cool air supply device comprising a compressor and condenser provided at a rear lower part of a main body and an evaporator, blowing fan, and defrosting heater installed in the first storage compartment; a low-temperature storage compartment damper to control supply of cool air to the first storage compartment; and a high-temperature storage compartment damper to control supply of hot air to the second storage compartment, the control method comprising:

controlling the low-temperature storage compartment damper to be opened and the high-temperature storage compartment damper to be closed while controlling the compressor and blowing fan to be driven so that the temperature of the first storage compartment reaches a low set temperature, thereby supplying cool air to the first storage compartment;

controlling the driving of the compressor and blowing fan to be stopped and the low-temperature storage compartment damper to be closed when the temperature of the first storage compartment reaches the low set temperature, thereby stopping the supply of cool air to the first storage compartment; and controlling the defrosting heater and blowing fan to be driven and the high-temperature storage compartment damper to be opened when the supply of cool air is stopped, thereby supplying hot air to the second storage compartment.

16. The control method according to claim 15, further comprising:

controlling the compressor to be driven and, after a predetermined time, controlling the blowing fan to be driven so that the temperature of the first storage compartment reaches the low set temperature;

controlling the defrosting heater to be driven after a predetermined time when the supply of cool air to the first storage compartment is stopped; and controlling the blowing fan to be driven after a predetermined time when the defrosting heater is driven.

17. The control method according to claim 15, further comprising controlling the driving of the defrosting heater to be stopped when temperature of the second storage compartment reaches a high set temperature, or the temperature of the first storage compartment is equal to or greater than the low set temperature, after hot air is supplied to the second storage compartment; and controlling the compressor to be driven after a predetermined time when the driving of the defrosting heater is stopped.

18. The control method according to claim 17, further comprising controlling the driving of the blowing fan to be stopped, the high-temperature storage compartment damper to be closed, and the compressor to be driven after a predetermined time when the driving of the defrosting heater is stopped.

* * * * *